US005435020A

United States Patent [19]

Maskell et al.

[11] Patent Number: 5,435,020

[45] Date of Patent: Jul. 25, 1995

[54] STEAM SHIELD WITH CONDENSATE FLOW CONTROL

[75] Inventors: Bruce W. Maskell, Suisun; Bob A. Davis, Napa, both of Calif.

[73] Assignee: Jacuzzi, Inc., Walnut Creek, Calif.

[21] Appl. No.: 281,921

[22] Filed: Jul. 28, 1994

[51] Int. Cl.[6] ..... A61H 33/06

[52] U.S. Cl. ..... 4/524

[58] Field of Search ..... 4/524–535; 607/83, 84

[56] References Cited

U.S. PATENT DOCUMENTS 4,296,507 10/1981 Janson ..... 4/524

FOREIGN PATENT DOCUMENTS 5038653 2/1993 Japan ..... 4/524
5095984 4/1993 Japan ..... 4/524
5285186 11/1993 Japan ..... 4/524

OTHER PUBLICATIONS

Jacuzzi Whirlpool Bath Owner's Manual (Assembly & Installation Instructions), J-Dream Model, p. 24, Jacuzzi Whirlpool Bath National Headquarters, P.O. Drawer J Walnut Creek, Calif. 94566 (Jun., 1991).

*Primary Examiner*—Charles E. Phillips
*Attorney, Agent, or Firm*—Limbach & Limbach

[57] ABSTRACT

A steam shield for controlling the flow of steam and condensate in the vicinity of a steam head. The steam shield has a generally flat portion with a hole of appropriate size and shape to accommodate a steam head, an inner lip portion formed around the flat portion, and an outer lip portion formed around the inner lip portion. The inner lip portion incorporates a reservoir for retaining condensate. The outer lip portion incorporates a surface with a drip barrier rail for directing the flow of condensate away from the wall upon which the steam shield is disposed.

9 Claims, 1 Drawing Sheet

STEAM SHIELD WITH CONDENSATE FLOW CONTROL

BACKGROUND OF THE INVENTION

1. Field of the Invention

The present invention relates to steam baths, steam showers and steam rooms and more particularly to a steam head which protrudes from a vertical wall.

2. Description of the Prior Art

For the purposes of comfort, health, hygiene and relaxation, many people desire and enjoy exposure to steam. To this end, there are steam baths, steam showers, steam rooms and other enclosures for containing steam in order to allow people to enjoy the benefits of steam exposure. The steam is often introduced into the enclosure via a steam head protruding from a vertical wall of the enclosure. Usually the steam is in the form of hot, vaporized water. However, other types of steam are sometimes used. For instance, vaporized water can imbued with fragrant or essential oils in order to produce steam for a medicinal practice called "Aromatherapy."

As it cools, steam will condense to form liquid condensate. However, even the condensate may have a temperature which exceeds normal room temperatures. Both the steam and condensate tend to have especially high temperatures in the vicinity of the steam head. For this reason there are devices, called steam shields, for partially enclosing the steam head so that occupants of the enclosure will not come into contact with the hottest steam or condensate.

Because the steam and condensate can be hot, enclosures for containing steam have conventionally been made from highly heat resistant materials such as cast iron or ceramic tiles. However, for some applications the walls of the enclosure are more optimally formed of materials with a somewhat lower heat resistance such as certain types of plastic-based materials.

While enclosure materials with a somewhat lower heat resistance may be able to withstand the heat from the steam and condensate over most of the enclosure area, these types of enclosures are more susceptible to problems, such as thermal cracking or discoloration, in the vicinity of the steam head, where the steam and condensate are especially hot. This problem can sometimes be aggravated by a steam shield because the steam shield may direct the flow of hot steam and/or condensate toward the enclosure wall in the vicinity of the steam head.

SUMMARY OF THE INVENTION

It is an object of the present invention to provides a steam shield which will protect occupants of the shower from the hottest steam, in the vicinity of the steam head, while simultaneously protecting the enclosure wall from the hottest steam and condensate, in the vicinity of the steam head.

It is a further object of the present invention to provide a steam shield which will minimize discoloration or thermal cracking of the steam enclosure caused by temperatures produced by vapor from a steam head. It is a further object of the present invention to deflect the direction of steam vapor flow and to diffuse the steam vapor as it enters the steam enclosure so that steam vapor flow is not directed toward an enclosure occupant. It is a further object of file invention to reduce the steam vapor temperature entering the steam enclosure in the vicinity of the steam head. It is a further object of the present invention to reduce the temperature of the condensate as it collects and drips onto the bottom of the steam enclosure.

The steam shield of the present invention is appropriate for use on a vertical wall of a steam enclosure to direct the flow of steam and condensate from a steam head protruding from the wall. The steam shield includes a generally flat portion with a hole of appropriate size and shape to accommodate the steam head. The steam shield also includes an inner lip portion formed around the flat portion. The steam shield also includes an outer lip portion formed around the inner lip portion.

According to one aspect of the present invention, the outer lip portion includes an outer lip condensate flow control portion which has a surface with a drip barrier rail which serves as a means for positively directing condensate away from the wall on which the steam shield is disposed.

According to another aspect of the present invention, the inner lip portion includes an inner lip condensate flow control portion which has a structure that will retain condensate. The structure to retain condensate can be formed as a protrusion or a depression in the surface of the inner lip condensate flow control portion. Alternatively, the inner lip condensate flow control portion may be formed to make an acute angle with the flat portion to provide a structure which will retain condensate between the inner lip condensate flow control portion and the flat portion.

A better understanding of the features and advantages of the present invention will be obtained by reference to the following detailed description and accompanying drawings which set forth illustrative embodiments in which the principles of the invention are utilized.

DETAILED DESCRIPTION OF THE PREFERRED EMBODIMENT

Figure 1:
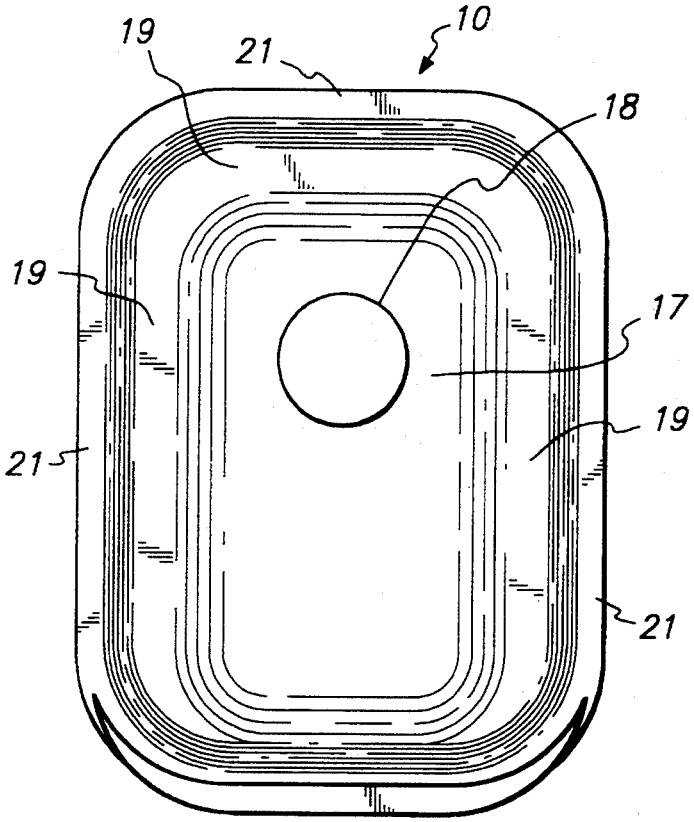
FIG. 1 is a plan view of a steam shield according to the present invention.
Figure 2:
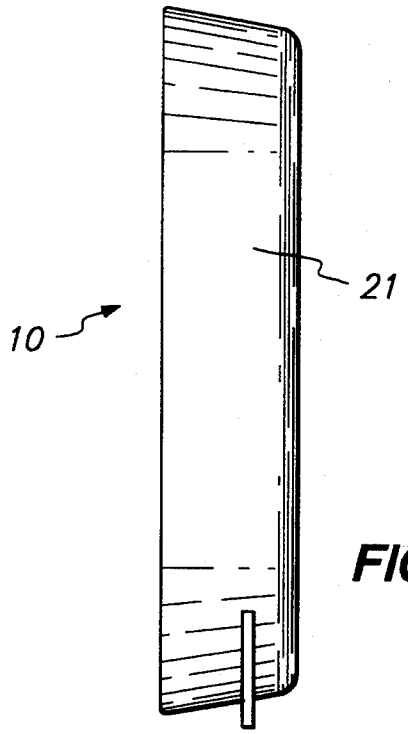
FIG. 2 is a side view of the steam shield of FIG. 1.

FIG. 1 shows a steam shield according to the present invention. Because the steam shield is used to direct the flow of hot steam and condensate, it is preferably formed of a heat resistant material such as polycarbonate. The steam shield 10 includes a central, flat portion 17 with a steam head hole 18 of appropriate size and shape for accommodating a steam head (shown in phantom lines as item 15 in FIG. 3). The steam shield 10 also includes an inner lip portion 19 and an outer lip portion 21 which will be described further in connection with FIG. 3. FIG. 2 shows a side view of the steam shield shown in FIG. 1.

Figure 3:
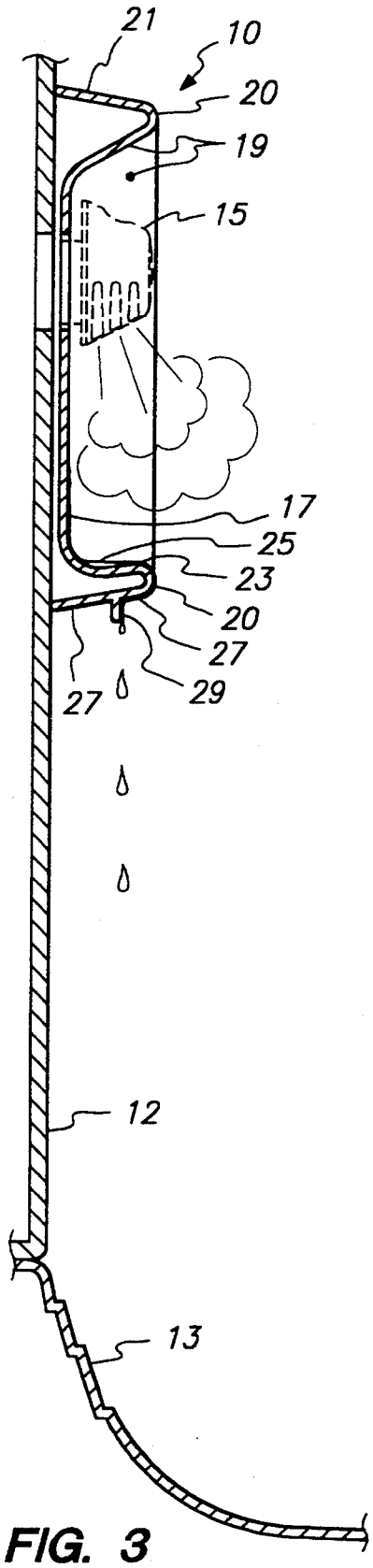
FIG. 3 is a cross-sectional view of a vertical steam enclosure wall, a steam enclosure bottom wall, a steam head and a steam shield according to the present invention.

FIG. 3 shows a section of a steam enclosure. A steam shield according to the present invention is denoted by reference numeral 10. The steam shield 10 is mounted along a vertical wall 12 of the steam enclosure. The vertical wall 12 runs down to the bottom 13 of the steam enclosure. The vertical wall 12 may undergo failure, such as thermal cracking, if it comes into direct contact with the hot steam and condensate in the vicinity of the steam head 15. The steam shield 10 works to prevent this hot steam and condensate from contacting the vertical wall 12.

The steam shield 10 has a generally flat portion 17 which is substantially parallel to the vertical wall 12 when the steam shield 10 is mounted. The steam head 15 protrudes through the flat portion 17. The flat portion 17 blocks steam and condensate in the vicinity of the steam head 15 from contacting the vertical wall 12. Some of the steam from the steam head 15 will be diffused by contact with the flat portion 17. Some of the steam will condensate on the flat portion 17. Driven by gravity, this condensate runs down the flat potion 17 in a direction toward the bottom 13 of the steam enclosure.

An inner lip portion 19 is formed around the flat portion 17. This inner lip portion can be formed entirely around the flat portion 17 (this is shown more clearly in FIG. 1). The inner lip portion 19 serves to diffuse the hot steam in the vicinity of the steam head 15. Some of the steam may condensate on the inner portion 19. This hot condensate will also run in a direction toward the bottom 13 of the steam enclosure.

An outer lip portion 21 is formed around the inner lip portion 19. The lip formed by the inner lip portion and outer lip portion helps to prevent occupants of the steam enclosure from inadvertently coming into contact with the steam head 15 and the very hot steam immediately issuing from the steam head 15. As shown in FIG. 3, the inner lip portion 19 and outer lip portion are formed to meet at a rounded edge 20.

The inner lip portion 19 includes an inner lip condensate flow control portion 23 on the side of the inner lip portion 19 proximate to the bottom of the steam shield 10. The inner lip condensate flow control portion 23 is shown as being formed at an acute angle to the flat portion 17. The space 25 thereby formed between the inner lip condensate flow control portion 23 and the flat portion 17 will serve to retain some of the hot condensate which has run down the flat portion 17 and the inner lip portion 19. In a preferred embodiment of the present invention, the inner lip condensate flow control portion 23 is formed at an angle of between 60° and 90° with the flat portion 17. The retained condensate will cool somewhat before the overflow runs out of the inner lip condensate flow control portion 23. In this way, the vertical wall 12 of the steam enclosure will be protected from hot condensate.

While FIG. 3 shows an inner lip condensate flow control portion 23 which retains condensate because it is formed at an acute angle to the flat portion, other structures are possible. The inner lip condensate flow control portion could be formed with a protrusion from its surface which acts as a dam to retain the cooling condensate temporarily. Also, the inner lip condensate flow control portion could be formed with a depression in its surface to act as a reservoir which will temporarily retain the cooling condensate.

Returning to FIG. 3, the outer lip portion 21 includes an outer lip condensate flow control portion 27 on a side of the outer lip portion 21 proximate to the bottom 13 of the steam enclosure. The outer lip condensate flow control portion has a drip barrier rail 29 in its surface formed as a sharp ridge of protruding material. Driven by gravity, cooling condensate runs over the inner lip condensate flow control portion 23 and begins to run over the outer lip condensate flow control portion 27. When the condensate reaches the drip barrier rail 29, the drip barrier rail 29 causes the condensate to fall away from the steam shield 10 in a direction approximately parallel to the vertical wall 12 of the steam enclosure, as shown in FIG. 3. The falling condensate will cool further before landing, which minimizes heat damage to the vertical wall 12 and bottom 13 of the steam enclosure. Also, because the condensate has been positively directed to fall in a direction roughly parallel to the vertical wall 12 by the drip barrier rail 29, the condensate falls in a spaced relationship to the wall to minimize heating and discoloration of the walls caused by hot condensate. If the condensate falls for a greater distance, it has more time to cool, and therefore cooler condensate will land on the surfaces of the steam enclosure.

In a preferred embodiment of the present invention, the drip barrier rail 29 is formed as a ridge with sides approximately parallel to the flat portion 17. This provides a positive method of controlling the condensate to fall in a direction roughly parallel with the vertical wall 12 of the steam enclosure. Also in this preferred embodiment of the invention, the outer lip condensate flow control portion 27 is formed approximately parallel to the inner lip condensate flow control portion 23.

It is to be understood that the present invention is not limited to the above described embodiments and that various changes and modifications could be made by those skilled in the art without departing from the spirit and scope of the invention defined in the appended claims.

What is claimed is:

1. A steam shield for use on a vertical wall of a steam enclosure to direct the flow of steam and condensate from a steam head protruding from the wall, the steam shield comprising:

a generally flat portion with a hole of appropriate size and shape to accommodate the steam head;

an inner lip portion formed around the flat portion; and an outer lip portion formed around the inner lip portion, with the outer lip portion including an outer lip condensate flow control portion having a surface with a drip barrier rail which serves as a means for directing condensate away from the wall on which the steam shield is disposed.

2. The steam shield according to claim 1, wherein the inner lip portion includes an inner lip condensate flow control portion to provide a reservoir for retaining condensate.

3. The steam shield according to claim 2, wherein the inner lip condensate flow control portion is formed at the bottom of the steam shield at an acute angle with respect to the flat portion to provide the reservoir.

4. The steam shield according to claim 2, wherein the means for retaining condensate is a depression formed in the surface of the inner lip condensate flow control portion.

5. The steam shield according to claim 2, wherein the steam shield is formed of polycarbonate material.

6. The steam shield according to claim 3, wherein the angle between the surface of the inner lip condensate flow control portion and the flat surface is between 60° and 90°, the surface of the outer lip condensate flow control portion is substantially parallel to the surface of the inner lip condensate flow control portion, the surface of the outer lip condensate flow control portion meets the surface of the inner lip condensate flow control portion over a rounded edge, ;red the drip barrier rail on the surface of the outer lip condensate flow control portion is formed as a protruding ridge with sides extending from the surface of the outer lip condensate flow control portion in a direction approximately parallel to the flat portion.

7. A steam shield for use on a vertical wall of a steam enclosure to direct the flow of steam and condensate from a steam head protruding from the wall, the steam shield comprising:

a flat portion with a hole of appropriate size and shape to accommodate the steam head;

an inner lip portion formed around the flat portion with the inner lip portion including an inner lip condensate flow control portion to provide a reservoir for retaining condensate; and an outer lip portion formed around the inner lip portion.

8. The steam shield according claim 7 wherein the inner lip condensate flow control portion is formed at the bottom of the steam shield at an acute angle with respect to the flat portion to provide the reservoir.

9. The steam shield according to claim 7 wherein the reservoir is a depression formed in the surface of the inner lip condensate flow control portion.

* * * * *